US010513836B2

(12) United States Patent
Leslie et al.

(10) Patent No.: US 10,513,836 B2
(45) Date of Patent: Dec. 24, 2019

(54) HEAVY DUTY EXCAVATOR BUCKET

(71) Applicant: CQMS PTY LTD, Murarrie (AU)

(72) Inventors: Bruce Alexander Leslie, Goodna (AU); Bevan Hall, Birkdale (AU); Simon Peter Orton, Highland Park (AU); Derek Mulder, Toowong (AU); David Andrews, Sherwood (AU)

(73) Assignee: CQMS PTY LTD (AU)

( * ) Notice: Subject to any disclaimer, the term of this patent is extended or adjusted under 35 U.S.C. 154(b) by 722 days.

(21) Appl. No.: 14/749,787

(22) Filed: Jun. 25, 2015

(65) Prior Publication Data

US 2015/0292177 A1 Oct. 15, 2015

Related U.S. Application Data

(63) Continuation-in-part of application No. 13/860,093, filed on Apr. 10, 2013, which is a continuation of application No. 13/039,959, filed on Mar. 3, 2011, now abandoned, which is a continuation of application No. 12/170,997, filed on Jul. 10, 2008, now abandoned.

(51) Int. Cl.
*E02F 3/40* (2006.01)
*E02F 3/60* (2006.01)

(52) U.S. Cl.
CPC . *E02F 3/40* (2013.01); *E02F 3/60* (2013.01)

(58) Field of Classification Search
CPC ..... E02F 3/48; E02F 3/60; E02F 3/40
See application file for complete search history.

(56) References Cited

U.S. PATENT DOCUMENTS

| | | | |
|---|---|---|---|
| 508,685 | A | 11/1893 | Davy |
| 645,864 | A | 3/1900 | Lyon |
| 656,987 | A | 8/1900 | Luther |
| 1,033,818 | A | 7/1912 | McKee et al. |
| 1,217,500 | A | 2/1917 | Rehally |
| 1,330,826 | A | 2/1920 | Turner |
| 1,500,104 | A | 7/1924 | Carlberg |
| 1,539,863 | A | 6/1925 | Pemberton |
| 1,803,654 | A | 5/1931 | Ronk |

(Continued)

FOREIGN PATENT DOCUMENTS

| | | |
|---|---|---|
| AU | 1952014135 | 1/1953 |
| AU | 1989034502 | 11/1989 |

(Continued)

*Primary Examiner* — Matthew Troutman
(74) *Attorney, Agent, or Firm* — Dureska & Moore, LLC; David P. Dureska; Brent L. Moore

(57) ABSTRACT

A heavy duty excavator bucket is constructed with an exoskeletal structure comprising coupled cast components including a lip member, opposed wing members, junction members locatable between floor and side walls and side and rear walls and a cap rail structure extending between opposed wing members about the upper periphery of the bucket to form an integral structure. Steel plate floor, side wall and rear wall members extend between adjacent exoskeletal regions. The bucket may include a cast arch member extending between opposed wing members and a cast reinforcing member extending between opposed junction members adjacent said rear wall.

20 Claims, 13 Drawing Sheets

(56) References Cited

U.S. PATENT DOCUMENTS

| | | | | | |
|---|---|---|---|---|---|
| 2,096,773 | A * | 10/1937 | Weimer | E02F 3/48 | 37/396 |
| 2,393,432 | A | 1/1946 | Turner | | |
| 2,591,278 | A | 4/1952 | Morgan | | |
| 3,048,292 | A | 8/1962 | Kohorst et al. | | |
| 3,056,219 | A | 10/1962 | Jeffrey | | |
| 3,076,275 | A | 2/1963 | Boothe | | |
| 3,195,747 | A | 7/1965 | Kashergen | | |
| RE33,198 | E | 4/1990 | Ballinger | | |
| 4,939,855 | A | 7/1990 | McCreary, Jr. | | |
| 4,944,102 | A * | 7/1990 | Behlendorf | E02F 3/60 | 37/398 |
| 5,063,694 | A | 11/1991 | McCreary, Jr. | | |
| 5,307,571 | A | 5/1994 | Behlendorf et al. | | |
| 5,400,530 | A * | 3/1995 | Schmidt | E02F 3/48 | 37/396 |
| 5,815,958 | A | 10/1998 | Olds et al. | | |
| 5,832,638 | A | 11/1998 | Watts | | |
| 6,662,478 | B1 | 12/2003 | Virnig | | |
| 6,834,449 | B2 | 12/2004 | Leslie et al. | | |
| 7,506,462 | B2 | 3/2009 | Reid | | |
| 7,721,473 | B2 | 5/2010 | Lunn | | |
| 8,572,870 | B2 | 11/2013 | Kudo et al. | | |
| 8,707,589 | B2 | 4/2014 | Hilton | | |
| 9,015,969 | B2 | 4/2015 | Knuth | | |
| 2009/0235560 | A1* | 9/2009 | Lumley | E02F 3/60 | 37/398 |
| 2010/0005689 | A1* | 1/2010 | Leslie | E02F 3/60 | 37/444 |
| 2011/0167682 | A1* | 7/2011 | Leslie | E02F 3/60 | 37/398 |
| 2012/0317847 | A1* | 12/2012 | Kubo | E02F 3/60 | 37/399 |
| 2014/0305011 | A1* | 10/2014 | Leslie | E02F 3/60 | 37/398 |

FOREIGN PATENT DOCUMENTS

| | | | |
|---|---|---|---|
| AU | 1993044244 | | 2/1994 |
| AU | 1993048965 | | 4/1994 |
| AU | 1994063073 | | 3/1995 |
| AU | 199670233 | B2 | 12/1997 |
| AU | 1999059059 | A1 | 3/2000 |
| AU | 2002301250 | B2 | 6/2003 |
| AU | 2007299572 | A1 | 3/2008 |
| AU | 2007202439 | A8 | 10/2008 |
| AU | 2013202801 | B2 | 2/2013 |

* cited by examiner

HEAVY DUTY EXCAVATOR BUCKET

CROSS-REFERENCE TO RELATED APPLICATION

This application is a continuation-in-part of U.S. patent application Ser. No. 13/860,093 filed Apr. 10, 2013, which is a continuation of U.S. patent application Ser. No. 13/039,959 filed Mar. 3, 2011, which is a continuation of U.S. patent application Ser. No. 12/170,997 filed Jul. 10, 2008, which are hereby incorporated by reference.

FIELD OF THE INVENTION

This invention is concerned with improvements in excavator buckets.

The invention is concerned particularly, although not exclusively with excavator buckets having a support arch.

BACKGROUND OF THE INVENTION

Dragline excavators represent a capital expenditure of hundreds of millions of dollars with operational overheads currently around US$6,000 per hour. In order to maximize operational efficiency and return on investment, this necessitates continuous operation of a dragline apparatus 24 hours a day, 7 days a week. Apart from routine shut-downs for maintenance requirements, any reduction in operational efficiency can represent substantial annual productivity losses.

Generally speaking, most draglines are a compromise between such factors as boom length, bucket and rigging mass and bucket payload capacity. Operational efficiencies of a dragline bucket can be measured according to a number of parameters including drag energy (or specific drag energy) and total sum load of the bucket, rigging and payload where:

DRAG ENERGY=a measure of the energy required to fill a bucket of given capacity. Factors affecting drag energy include the extent of frictional engagement between internal and external bucket surfaces and earth masses within and without the bucket respectively, tooth/cutting edge configurations and the dead mass of the bucket/rigging combination.

SPECIFIC DRAG ENERGY=the drag energy expended per kg of payload excavated.

TOTAL SUM LOAD (TSL)=the sum of the masses of the bucket rigging and payload.

Since the early 1900's, there have been many modifications to bucket designs and rigging configurations in an endeavour to achieve greater excavation efficiencies in terms of energy consumption and excavation rates. During the last century, bucket capacities have increased from about 20 tonnes to over 100 tonnes.

Excavator bucket designs generally are of an arched or archless design with some excavator operators preferring an arched design at the expense of reduced payload to obtain a more robust bucket with lower maintenance requirements. Generally the mass of an archless bucket and rigging is less than that of an arched bucket and associated rigging largely due to the exclusion of the arch over the front of the bucket. It is argued in some quarters that increased productivity offsets any increases in maintenance of a less robust archless bucket but, at the end of the day, the decision as to which bucket is employed is often predicated on the type of earthen material to be excavated with the archless bucket being used with softer, less aggressive, easily penetrated earth types.

Examples of archless buckets are described in U.S. Pat. Nos. 2,096,773; 2,334,460; 3,247,606; 3,247,607, 5,400,530 and 5,832,638, whereas examples of arched buckets are described in U.S. Pat. Nos. 3,597,865; 4,791,738; 4,944,102; 5,140,761; 5,307,571; 5,343,641; 5,343,702; 5,428,909; 5,575,092 and 6,705,031.

The archless buckets referred to above are generally of a low mass and are fabricated from steel plate components with generally parallel side walls, a rearwardly inclined rear wall and, with the exception of U.S. Pat. Nos. 3,247,606 and 3,247,607 which have side walls perpendicular to a floor, all others describe outwardly and upwardly inclined side walls. The geometry of these buckets was claimed to increase bucket payload and to provide less frictional resistance between the earth mass and the bucket during loading.

The arched buckets described above generally comprise generally slab sided structures with side walls perpendicular to a floor and an arcuate transition between the floor and a rear wall which may incline outwardly or inwardly towards the top thereof. The arched buckets generally have a more robust construction than the archless buckets described above, and generally are fabricated from sheet steel components and cast components such as the bucket lip, cheek plates, the arch member and/or arch mountings. Reinforcing members such as trunnion mounting plates and a cap rail formed along the upper edges of the side and rear walls were generally fabricated from sheet steel.

The above-mentioned prior art excavator buckets are illustrative of on-going endeavours for over a century to produce more efficient buckets while over that same period accommodating demands for buckets with greater load capacity. In the many, many patents granted for improvements in excavator buckets over the last century or so, most of those inventions dealt with single incremental improvements which may have improved one aspect of the performance of the bucket but often at the expense of one or more other functional or structural aspects of the bucket whereby the overall or net benefits represented only a marginal improvement.

Some of the shortcomings of the prior art excavator buckets were addressed in U.S. Pat. No. 6,834,449 to the same assignee. This patent described a light-weight high capacity archless bucket which exhibited a payload increase of about 10% over competitors' conventional buckets along with a reduction in drag energy of about 30% of that of a conventional bucket while at the same time reducing bucket fill time by 20%. This bucket was robust in nature with a cast front lip, cheek plates and junction members between side and rear walls to provide a smooth arcuate transition therebetween to reduce frictional engagement with a mass of earth during filling and emptying of the bucket. The bucket had a wide, relatively shallow configuration when compared to conventional excavator buckets at that time and was distinguished by a rear wall being higher than that adjacent side wall portions with a steep arcuate taper between the floor and the top of the rear wall.

The bucket of U.S. Pat. No. 6,834,449 had a side wall height:lip width ratio of about 1:4 compared with conventional prior art buckets having a ratio of about 1:1.5 to 1:2.

In plan view, the side walls converged toward the rear wall such that the rear portion of the bucket was about 80% of the effective width of the opening between opposed cheek plates.

While generally effective for its intended purpose, the excavator bucket described in U.S. Pat. No. 6,834,449 was suited more to lighter, softer earth types rather than harder rock filled earth types found in certain regions.

Accordingly, it is an aim of the present invention to overcome or alleviate at least some of the shortcomings of prior art excavator buckets and otherwise to provide a robust heavy duty excavator bucket which still exhibits the improved operational efficiencies of the light-weight buckets described in U.S. Pat. No. 6,834,449.

SUMMARY OF THE INVENTION

According to one aspect of the invention there is provided an excavator bucket comprising:— a generally rectangular floor, opposed side walls and a rear wall;

a lip member extending transversely of a front portion of said floor, said lip member including spaced mountings for replaceable wear members;

opposed wing members adjacent respective front portions of said side walls, said wing members including mountings for replaceable wear members, said wing members each including a drag rope mounting located forwardly of a front edge of said lip member; said excavator bucket characterized in that said side walls extend substantially parallel to each other and incline outwardly towards respective upper regions thereof at an angle of from 5° to 20° relative to a plane perpendicular to a plane of said floor, said excavator bucket further characterized in that a ratio of lip width to side wall height in the region of said lip member is in the range of from 3.1:1.0 to 3.6:1.0.

Preferably, said side walls may incline outwardly at an angle of from 10° to 15°.

Preferably, said side walls incline outwardly at an angle from 12° to 15°.

Preferably, said side walls are inclined outwardly at an angle of approximately 15°. In a further form, preferably said side walls are inclined outwardly at an angle of approximately 5°.

Preferably, the ratio of lip width to side wall height is further in the range of from 2.50:1.0 to less than 3.1:1.0 and from greater than 3.6:1.0 to 4.4:1.0.

Preferably, the ratio of lip width to side wall height is further in the range of from 2.50:1.0 to less than 2.94:1.0 and from greater than 3.8:1.0 to 4.4:1.0.

Preferably, the ratio of lip width to side wall height is further in the range of from 4.0:1.0 to 4.4:1.0.

Suitably, said ratio of lip width to side wall height is in the range of from 3.2:1.0 to 3.5:1.0.

Preferably, said ratio of lip width to side wall height is in the range of from 3.3:1.0 to 3.4:1.0.

If required, said excavator bucket may include an arch member extending between said opposed wing members.

Preferably, said arch member comprises a hollow cast steel member.

Suitably, said excavator bucket may comprise cast steel junction members between said floor and said side walls and said side walls and said rear wall respectively, said junction members being shaped to provide a smooth arcuate transition between adjacent said floor and said side walls and said side walls and said rear wall respectively.

If required, said rear wall may curve upwardly from a junction with said floor.

Preferably, an upper portion of said rear wall may incline outwardly from a lower portion of said rear wall.

A cast steel cap rail may extend along the upper edges of said side walls and said rear wall.

If required, a cast steel reinforcing member may extend transversely over an outer surface of a lower portion of said rear wall.

Suitably, said excavator bucket comprises an exoskeletal structure of cast steel components supporting the plate steel floor, side wall and rear wall members.

The exoskeletal structure may comprise said lip member, said wing members, said junction members and said cap rail.

If required, said exoskeletal structure may include said arch member.

Said exoskeletal structure may also include said cast steel reinforcing member extending between opposed junction members.

Suitably, said exoskeletal structure includes coupling members extending between said junction members and said cap rail adjacent said rear wall.

Preferably, said coupling members comprise trunnion mounts.

Preferably, the ratio of the length of the floor to the width of the floor is further in the range of from 0.8:1.0 to less than 1.0:1.0 and from greater than 1.25:1.0 to 1.6:1.0.

Preferably, the ratio of the length of the floor to the width of the floor is further in the range of from 0.8:1.0 to less than 1.0:1.0 and from greater than 1.33:1.0 to 1.6:1.0.

Preferably, the ratio of the length of the floor to the width of the floor is in the range of from 1.4:1.0 to 1.6:1.0.

Preferably, the ratio of the length of the floor to the width of the floor is in the range of from 1.0:1.25.

If required, said bucket may include payload spill containment members extending adjacent rear upper edges of said side walls and said rear wall.

In a further form, the invention resides in an excavator bucket comprising:

a generally rectangular floor, opposed side walls and a rear wall;

a lip member extending transversely of a front portion of said floor, said lip member including spaced mountings for replaceable wear members;

opposed wing members adjacent respective front portions of said side walls, said wing members including mountings for replaceable wear members, said wing members each including a drag rope mounting located forwardly of a front edge of said lip member; said excavator bucket characterized in that said side walls extend substantially parallel to each other, said excavator bucket further characterized in that a ratio of lip width to side wall height in the region of said lip member is in the range of:

from 2.50:1.0 to less than 2.94:1.0;

from 2.94:1.0 to 3.8:1.0; and from greater than 3.8:1.0 to 4.4:1.0.

Preferably, the excavator bucket is herein as described.

In a further form, the invention resides in an excavator bucket comprising:

a generally rectangular floor, opposed side walls and a rear wall;

a lip member extending transversely of a front portion of said floor, said lip member including spaced mountings for replaceable wear members;

opposed wing members adjacent respective front portions of said side walls, said wing members including mountings for replaceable wear members, said wing members each including a drag rope mounting located forwardly of a front edge of said lip member; said excavator bucket characterized in that said side walls extend substantially parallel to each other, said excavator bucket further characterized in that a ratio of lip width to side wall height in the region of said lip member is in the range of:

from 2.50:1.0 to less than 2.94:1.0; and from greater than 3.8:1.0 to 4.4:1.0.

Preferably, the excavator bucket is herein as described.

In a further form, the invention resides in an excavator bucket comprising:

a generally rectangular floor, opposed side walls and a rear wall;

a lip member extending transversely of a front portion of said floor, said lip member including spaced mountings for replaceable wear members;

opposed wing members adjacent respective front portions of said side walls, said wing members including mountings for replaceable wear members, said wing members each including a drag rope mounting located forwardly of a front edge of said lip member; said excavator bucket characterized in that said side walls incline outwardly towards respective upper regions thereof at an angle of from 5° to 20° relative to a plane perpendicular to a plane of said floor, said excavator bucket further characterized in that a ratio of lip width to side wall height in the region of said lip member is in the range of from 2.5:1.0 to 4.4:1 and the ratio of the length of the floor to the width of the floor is in the range of from 0.8:1.0 to 1.6:1.0.

Preferably, the excavator bucket is herein as described.

In a further form, the invention resides in an excavator bucket comprising:

a generally rectangular floor, opposed side walls and a rear wall;

a lip member extending transversely of a front portion of said floor, said lip member including spaced mountings for replaceable wear members;

opposed wing members adjacent respective front portions of said side walls, said wing members including mountings for replaceable wear members, said wing members each including a drag rope mounting located forwardly of a front edge of said lip member; said excavator bucket characterized in that said side walls extend substantially parallel to each other, said excavator bucket further characterized in that a ratio of lip width to side wall height in the region of said lip member is in the range of from 2.5:1.0 to 4.4:1.0 and the ratio of the length of the floor to the width of the floor is in the range of from 0.8:1.0 to 1.6:1.0.

Preferably, the excavator bucket is herein as described.

In a further form, the invention resides in an excavator bucket comprising:

a generally rectangular floor, opposed side walls and a rear wall;

a lip member extending transversely of a front portion of said floor, said lip member including spaced mountings for replaceable wear members;

opposed wing members adjacent respective front portions of said side walls, said wing members including mountings for replaceable wear members, said wing members each including a drag rope mounting located forwardly of a front edge of said lip member; said excavator bucket characterized in that said side walls incline outwardly towards respective upper regions thereof at an angle of from 5° to 20° relative to a plane perpendicular to a plane of said floor, said excavator bucket further characterized in that a ratio of the length of the floor to side wall height in the region of said lip member is in the range of from 2.0:1.0 to 6.5:1.0.

Throughout this specification, unless the context requires otherwise, the words "comprise", "comprises" and "comprising" will be understood to imply the inclusion of a stated integer or group of integers but not the exclusion of any other integer or group of integers.

BRIEF DESCRIPTION OF THE DRAWINGS

In order that the invention may be fully understood and put into practical effect, reference will now be made to preferred embodiments illustrated in the accompanying drawings in which:—

For the sake of simplicity where appropriate, like reference numerals have been employed for like features in the drawings.

DETAILED DESCRIPTION OF THE DRAWINGS

Figure 1:
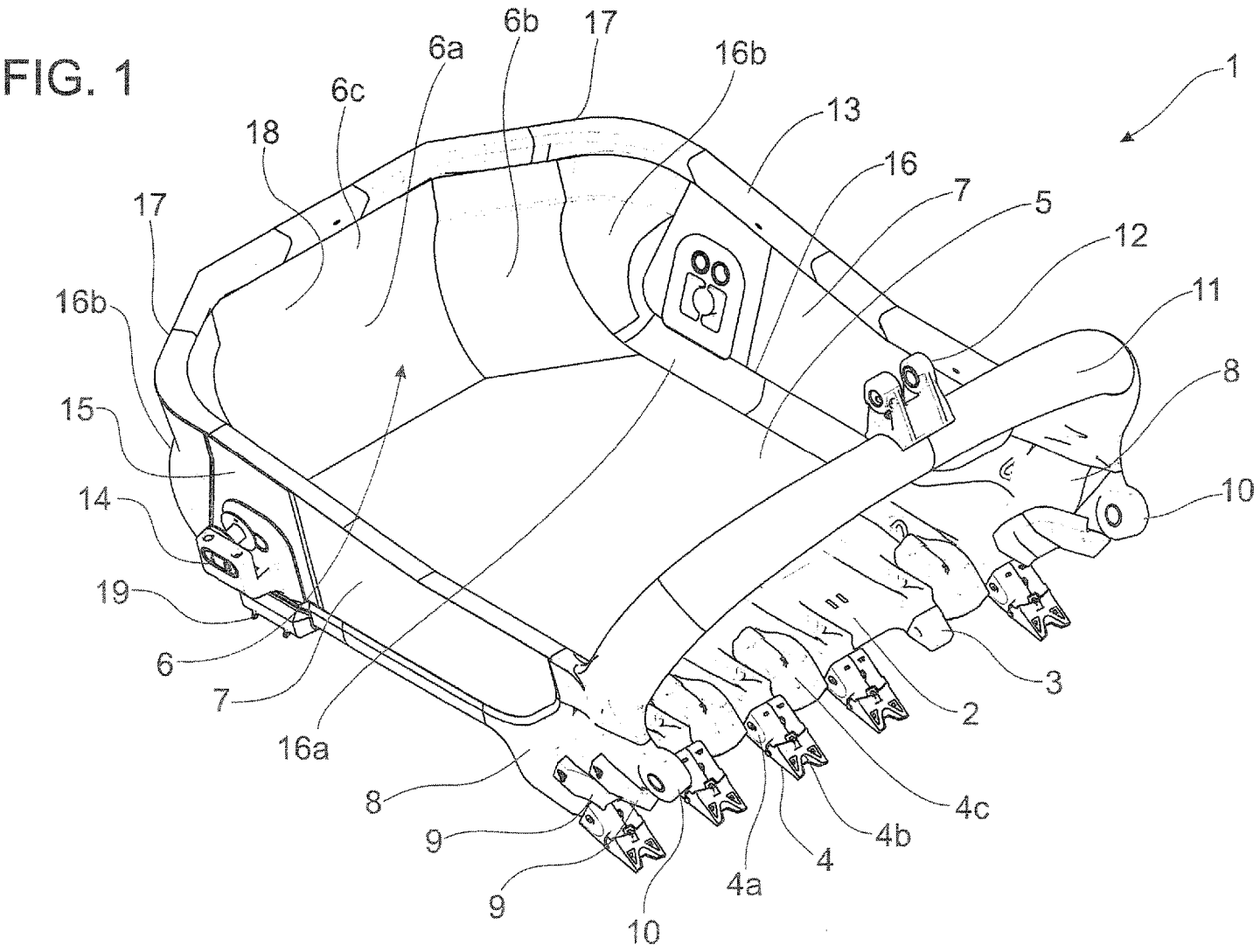
FIG. 1 shows a perspective view from above of an excavator bucket according to an embodiment of the invention.

FIG. 1 shows a perspective view from above of an excavator bucket 1 according to the invention. Bucket 1 comprises a cast lip 2 having spaced noses 3 integrally formed therewith to support replaceable wear member components 4 in the form of adaptors 4*a* and cutting teeth 4*b*. Located between spaced noses 3 are replaceable lip shrouds 4*c*. Extending rearwardly from lip 2 is a plate steel floor 5 and an upwardly curved rear wall 6. Plate steel side walls 7 extend rearwardly of cast side wing members 8 extending upwardly from lip 2. Wing members 8 support replaceable wear members in the form of wing shrouds 9 and formed integrally with wing members 8 are drag rope bushes 10. A cast arch member 11 extends between opposed wing members 8 and supports a mounting bracket 12 for connection to a drag rope rigging assembly (not shown). A cap rail 13 fabricated from cast steel components is secured about the upper edges of the side and rear walls 7, 6 and trunnion brackets 14 are secured to reinforced trunnion mount panels 15. The trunnion brackets 14 are used for connection to a hoist rope rigging assembly (not shown). A cast junction member 16 extends along each side of the bucket rearwardly of wing members 8 to form a smooth arcuate transition region 16*a* between floor 5 and side walls 7 and similarly forms a smooth arcuate corner transition region 16*b* between side walls 7 and rear walls 6. Junction members 16 are formed from a plurality of castings welded together to form a unitary member. Rear wall 6 includes a central transverse element 6*a* and forwardly directed outer elements 6*b* which, together with the transition region 16*b* form generally chamfered corners 17 at the rear of bucket 1. Between the upper edge 18 of the curved portion of rear wall 6 is an outwardly inclined rear wall portion 6*c* (shown more clearly in FIG. 2). Located on the outer surface of junction member 16 below trunnion brackets 14 are replaceable wear members 19 (shown more clearly in FIG. 2).

Figure 2:
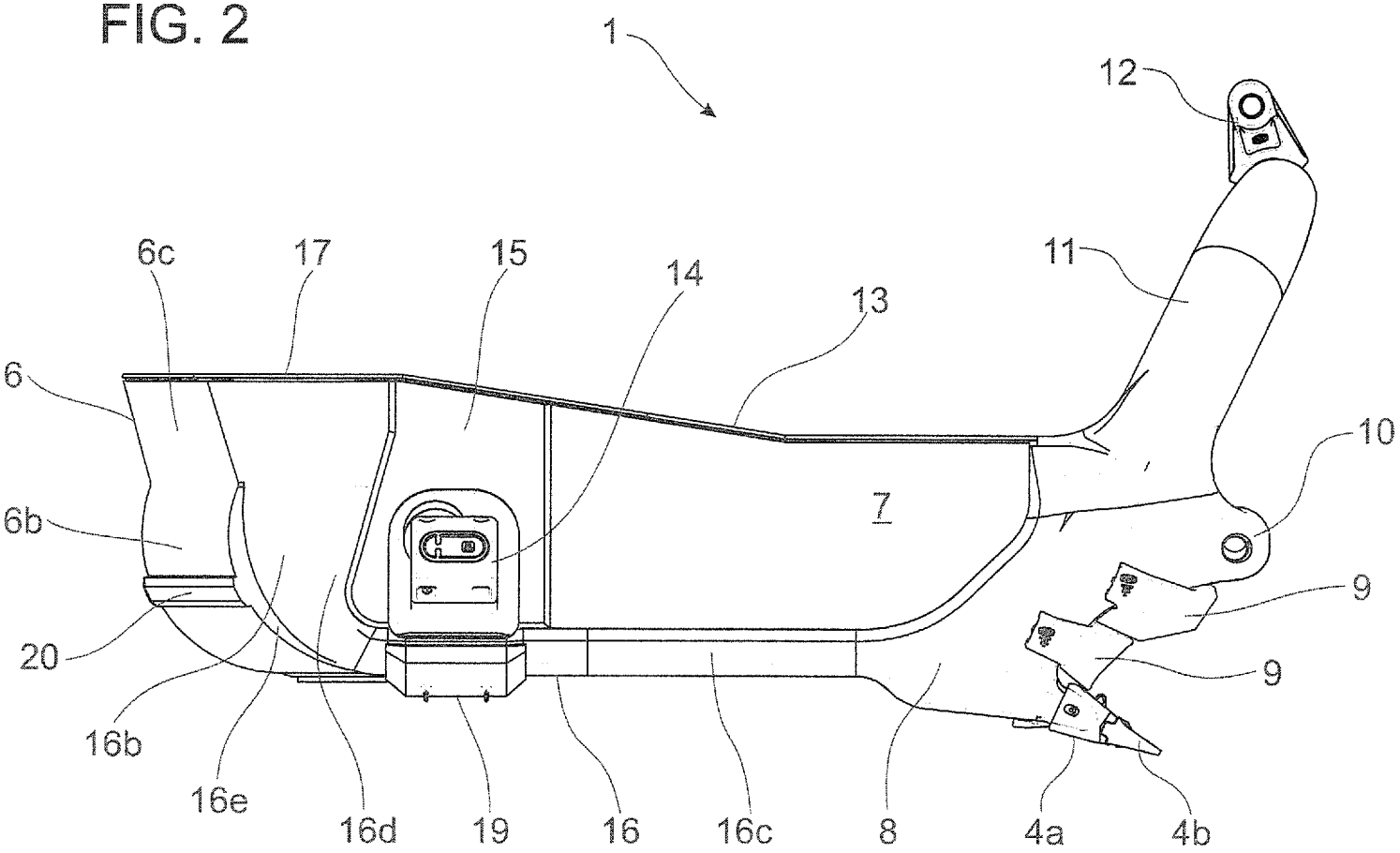
FIG. 2 shows a side elevational view of the bucket of FIG. 1.

FIG. 2 shows a side elevational view of the bucket of FIG. 1.

As illustrated, junction member 16 is formed from a plurality of cast steel components 16*a*, 16*b* and 16*c*, and corner transition region 16*b* is formed with side flanges 16*d*, 16*e* to enable attachment of side walls 7 and rear wall elements 6*b* by welding. Steel reinforcing panel ribs 20 extends about the outer surface of rear wall 6 and is secured by welding at opposite ends to respective flanges 16*e* of junction members 16.

Trunnion brackets 14 allow adjustable positioning of the trunnions (not shown) to selectively vary the carry angle of the bucket for particular dragline rigging systems.

As shown, the top edges of the front region of the side walls 7 adjacent the lips/wing/arch combination 2, 8, 11 extend generally parallel to the plane of the bucket floor and at a position intermediate the trunnion brackets 14 and the drag bushes 10, the side walls 7 incline upwardly and rearwardly to a position adjacent trunnion brackets 14 and thereafter extend to the rear wall 6 substantially parallel to the plane of the bucket floor.

Figure 3:
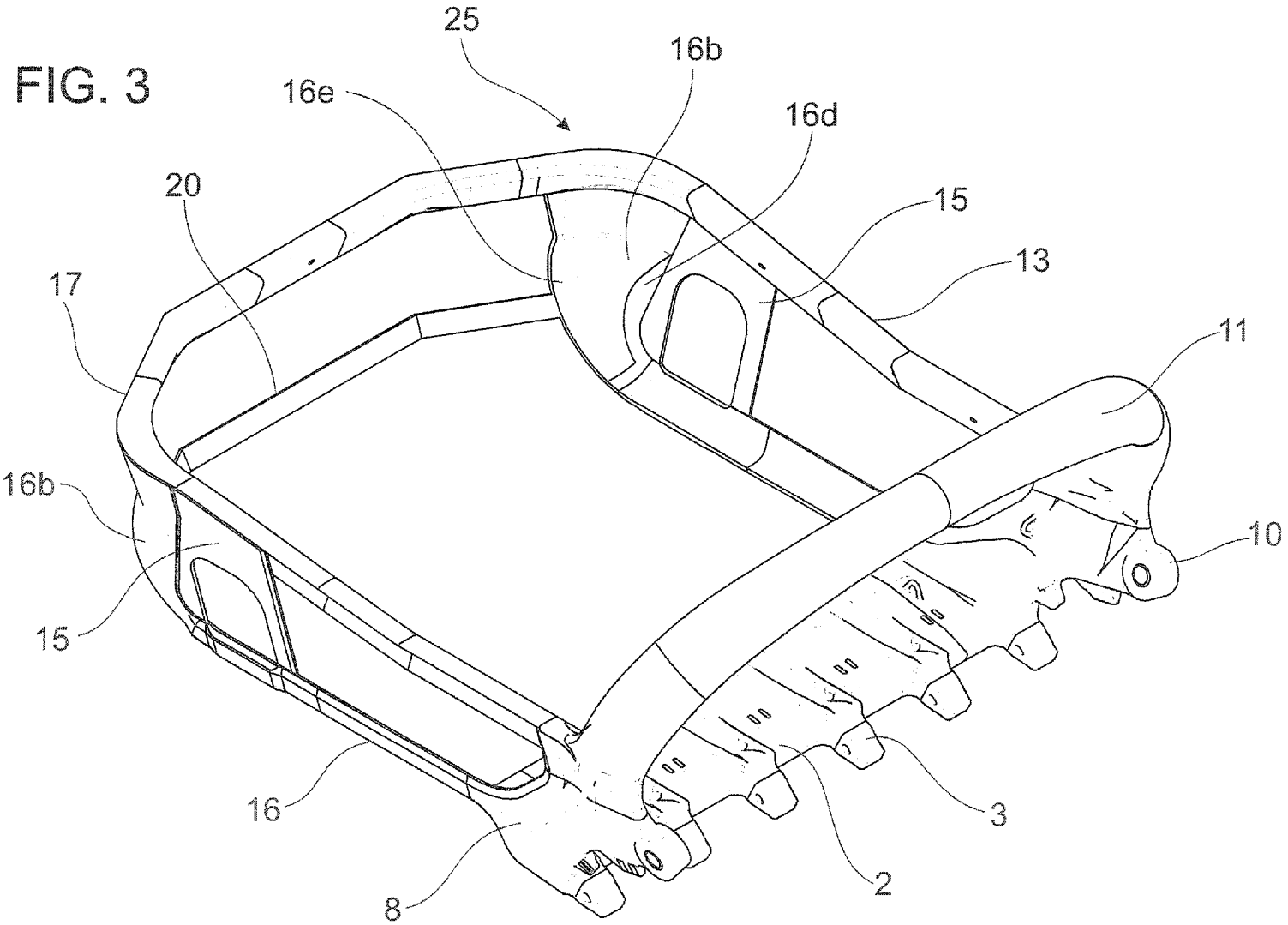
FIG. 3 shows the exoskeletal structure of the bucket of FIGS. 1 and 2.

FIG. 3 shows the configuration of the exoskeletal structure 20 of the bucket of FIGS. 1 and 2.

Exoskeletal structure 25 comprises a plurality of cast elements welded together to provide a rigid integral frame to which steel plating is applied to form the floor, rear wall and side walls of the bucket. The cast elements include the lip 2, side wings 8, arch 11, junction members 16, reinforcing rib 20 and cap rail 13. The cap rail structure 13 is fabricated from a plurality of discrete castings which are welded together to form an integral member. Each cap rail casting has a cross-sectional shape similar to the numeral "7" to form a generally planar head extending outwardly away from the interior of the bucket and a buttress-like leg portion extending downwardly and outwardly. When the side and rear wall plates are secured to the cast exoskeletal structure, the cap rail structure, together with the upper region of the side and rear wall plates, forms a rigid hollow flange of generally triangular cross-section extending about the upper periphery of the bucket walls.

The cap rail castings are formed with generous head width and leg height dimensions to suit a wide range of bucket sizes simply by trimming off any excess head width or leg length. More importantly however, particularly in the rear portion of the bucket, the adjustable cap rail leg height permits optimization of a bucket size to suit a particular excavator operation or particular environmental conditions of a given work site while maintaining an optimum carry angle for the bucket. While lip 2 and side wings 8 are generally cast as single members, junction members 16, cap rail 13 and reinforcing rib 20 are fabricated from a plurality of cast steel sub elements welded together. If required, heavy plate steel trunnion bracket mounts 15 may also serve as part of the exoskeletal structure.

Figure 4:
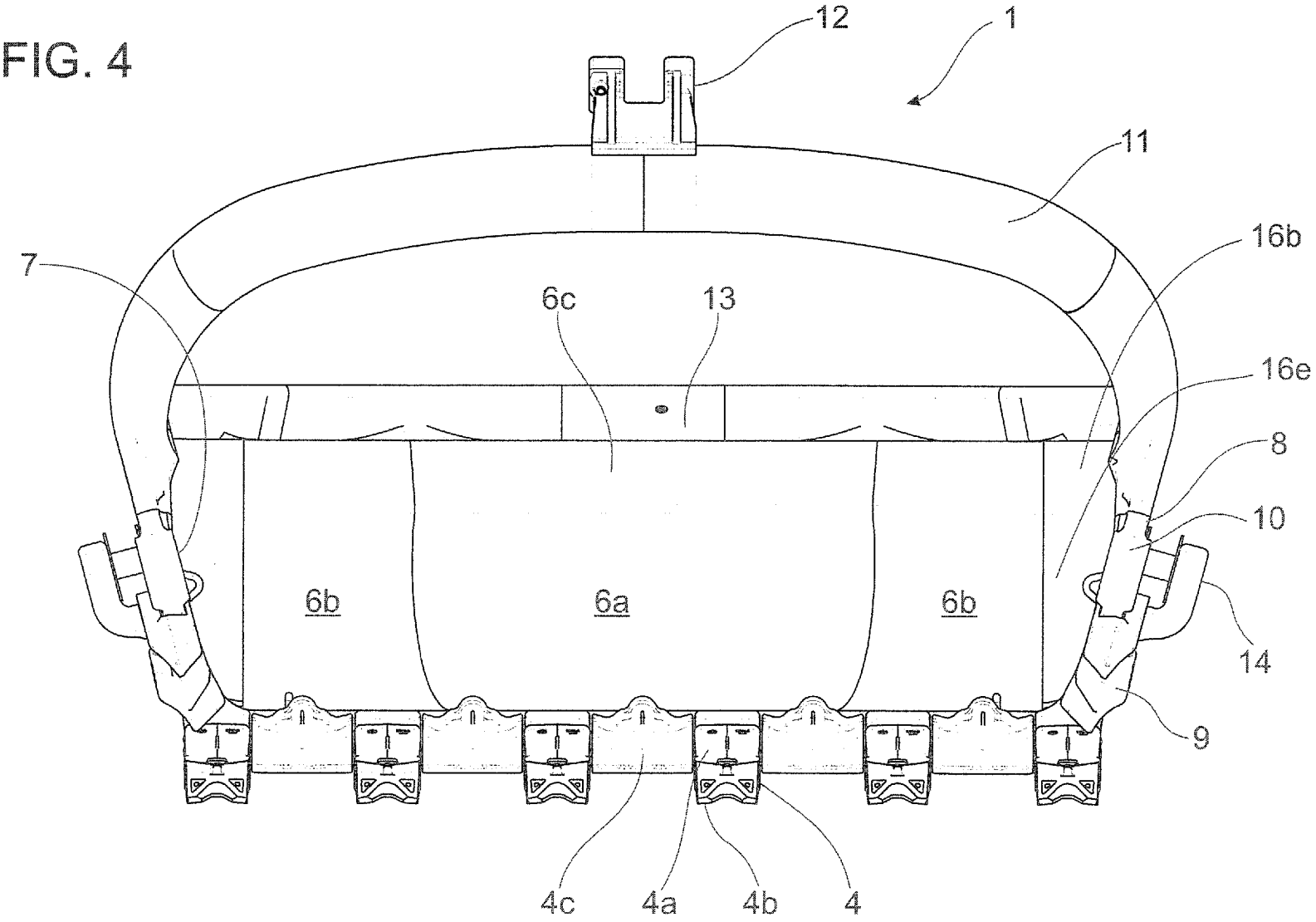
FIG. 4 shows a front elevational view of the bucket of FIGS. 1 and 2.

FIG. 4 shows a front elevational view of the bucket 1 of FIGS. 1 and 2.

As illustrated, the mouth of bracket 1 is characterized in that each side wall 7 is inclined outwardly towards a top edge at an included angle of about 105° between the plane of the side wall 7 and the floor of the bucket.

Another characteristic of the bucket mouth is the ratio of the median width (taken at a point halfway between the upper and lower edges of the front portion of side wall 7) and the height of wall 7 at the forward end thereof. As illustrated, this width is about 3.42:1 and the significance of these characterizing features of the bucket mouth geometry will be discussed in detail later.

Figure 5:
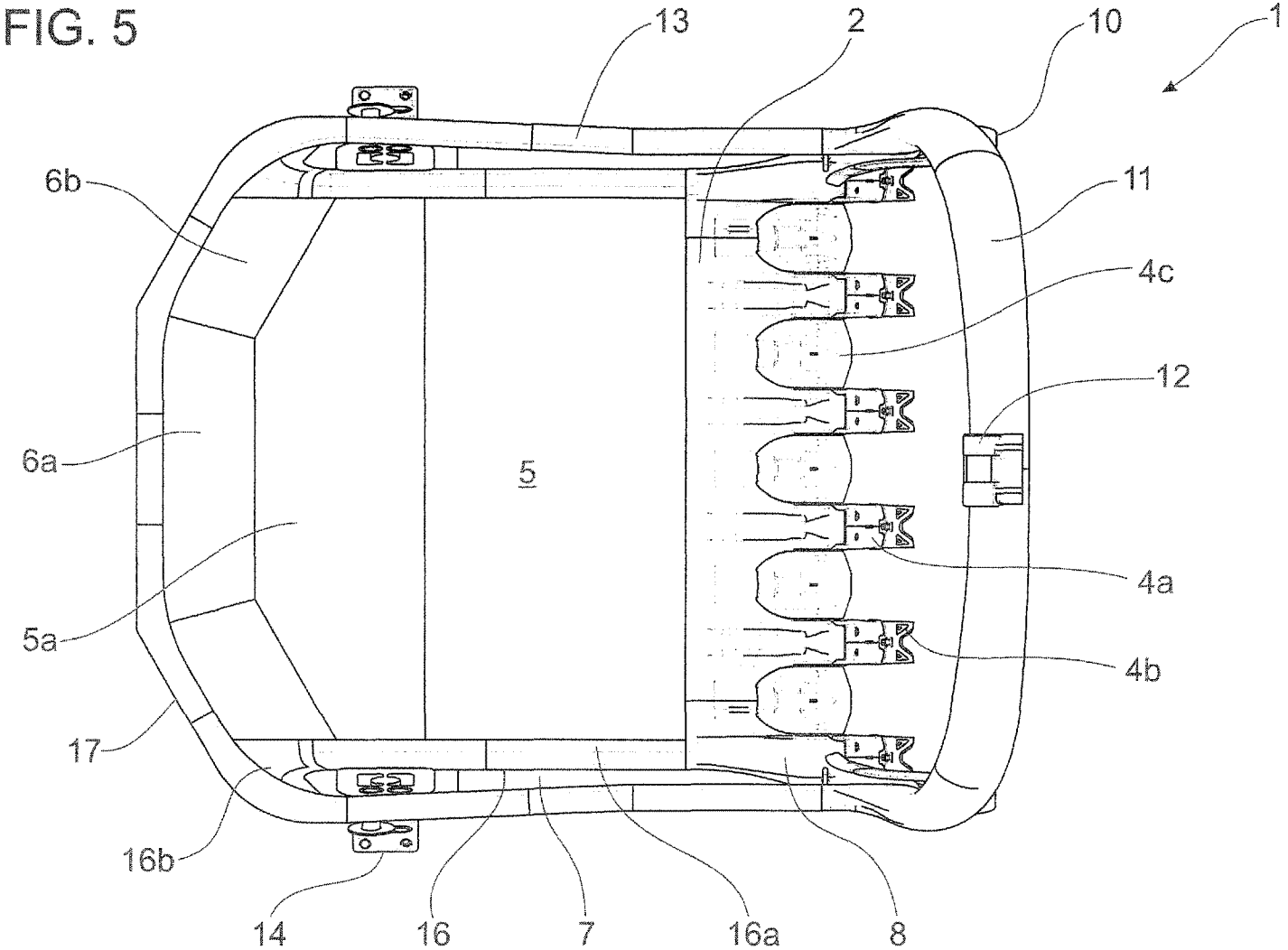
FIG. 5 shows a top plan view of the bucket of FIGS. 1 and 2.

FIG. 5 shows a top plan view of the bucket of FIGS. 1, 2 and 4.

As illustrated, bucket 1 has an effective floor length to width ratio of about 1.18:1.00 wherein floor length is measured between the front edge (not shown) of lip 2 and a point approximately halfway between the joint between rear floor panel 5*a* and rear wall panel 6*a* on the one hand and a point where an outer corner of rear floor panel 5*a*, rear wall panel 6*b* and junction member 16 intersect. Again the significance of this ratio will be discussed later.

In an endeavour to ascertain those characteristics which might optimize the operational performance of a heavy duty excavator bucket in particular, a number of geometrical relationships in an excavator bucket configuration were examined and compared with the contemporary "EARTHEATER"™ heavy duty excavator bucket of the assignee. Amongst the heavy duty excavator buckets currently available in the marketplace, the "EARTHEATER"™ bucket is considered to be one of the more efficient buckets.

Careful practical and finite element analyses of contemporary bucket designs suggested that there may be a relationship between the length and width of the bucket floor as well as the width and height of the bucket mouth as exhibited in the comparison between a conventional heavy duty bucket and the light-weight bucket disclosed in U.S. Pat. No. 6,834,449 to the same assignee. The following table represents a comparison between a conventional excavator bucket such as a CQMS "EARTHEATER"™, ESCO or P & H 37 tonne bucket and the light-weight bucket of U.S. Pat. No. 6,834,449.

TABLE 1

| PROPERTY | PRIOR ART (AV.) | BUCKET OF U.S. Pat. No. 6,834,449 |
|---|---|---|
| Bucket Mass | 37 tonne | 27 tonne |
| Payload | 95 tonne | 105 tonne |
| Lip Width | 4.2 metres | 5.5 metres |
| Side Wall Height | 2.5 metres | 1.2-1.5 metres |
| Bucket Fill Time | 15 seconds | 12 seconds |

The prior art heavy duty buckets have a lip width to wall height ratio of 1.2-1.5:1 compared to about 4:1 for the light-weight bucket of U.S. Pat. No. 6,834,449 which suggests ratios in the range of from 3:1 to 4:1 may be effective.

Similarly, typical prior art heavy duty buckets have a floor contact length, as a proportion of overall bucket length measuring from the tips of the cutting teeth, of about 75% for the bucket of U.S. Pat. No. 5,822,638 or up to about 85% for a contemporary prior art bucket disclosed in U.S. Pat. No. 4,791,738.

The bucket of U.S. Pat. No. 6,834,449 describes rearwardly converging side walls in combination with an upwardly tapering floor as applying a progressive restriction to an earth slab being excavated until the restrictive pressures effectively arrest the slab at the rear wall of the bucket. At that stage, a further slab is forced up and over the initial slab to maximize the payload fill. The bucket is said to exhibit a payload increase of about 10% over prior art heavy duty buckets while at the same time reducing drag energy and bucket fill time to 70% and 20% respectively of a conventional bucket.

In order to examine bucket efficiencies with a wide range of geometric variations, a scale modular bucket assembly was devised to enable identification of factors which might optimize or at least significantly improve bucket productivity. A similar scale CQMS "EARTHEATER"™ bucket having the same capacity was utilized as a reference. The parameters under consideration were:—

(a) width to height ratio of bucket mouth
(b) length to width ratio
(c) configuration of bucket rear
(d) influence of sloping walls Starting with a constant lip width, the front portion of the bucket was designed to accommodate side walls, inclined outwardly from the floor at an included angle of 95°, in three different heights giving width to height ratio of 2.9, 3.2 and 3.5 to one where the average width was measured midway up the side wall. Wall height variations were accommodated by removable side plates attachable to the upper edges of the bucket side walls.

The arch was fabricated to accommodate outward wall inclinations of 5° and 15° relative to a vertical datum and for the 15° inclined walls the resultant average width to height rations were 3.2, 3.5 and 3.8 to one. This arose because the more inclined walls gave rise to a greater average width and a slightly reduced height.

The bucket was constructed with interchangeable rear ends, two of which had a conventional rectangular rear wall curving upwardly from the floor and the other two had tapered rear corners. Each pair of rear ends was manufactured with 5° and 15° sloping side walls.

The length of the bucket was measured from the front edge of the lip to the rear wall.

Testing of each of twelve bucket configurations was performed using a scale dragline apparatus with digging at a range of depths for a sufficient number of cycles to allow testing and performance averaging over a range of digging conditions.

A cycle by cycle analyses of test data was performed and the results averaged for each bucket configuration. The test results are set forth in Table 2 below.

From the test data compilated in Table 2 above, the relationships between a number of bucket parameters was examined and graphs of these relationships were plotted as follows:—

Figure 6:
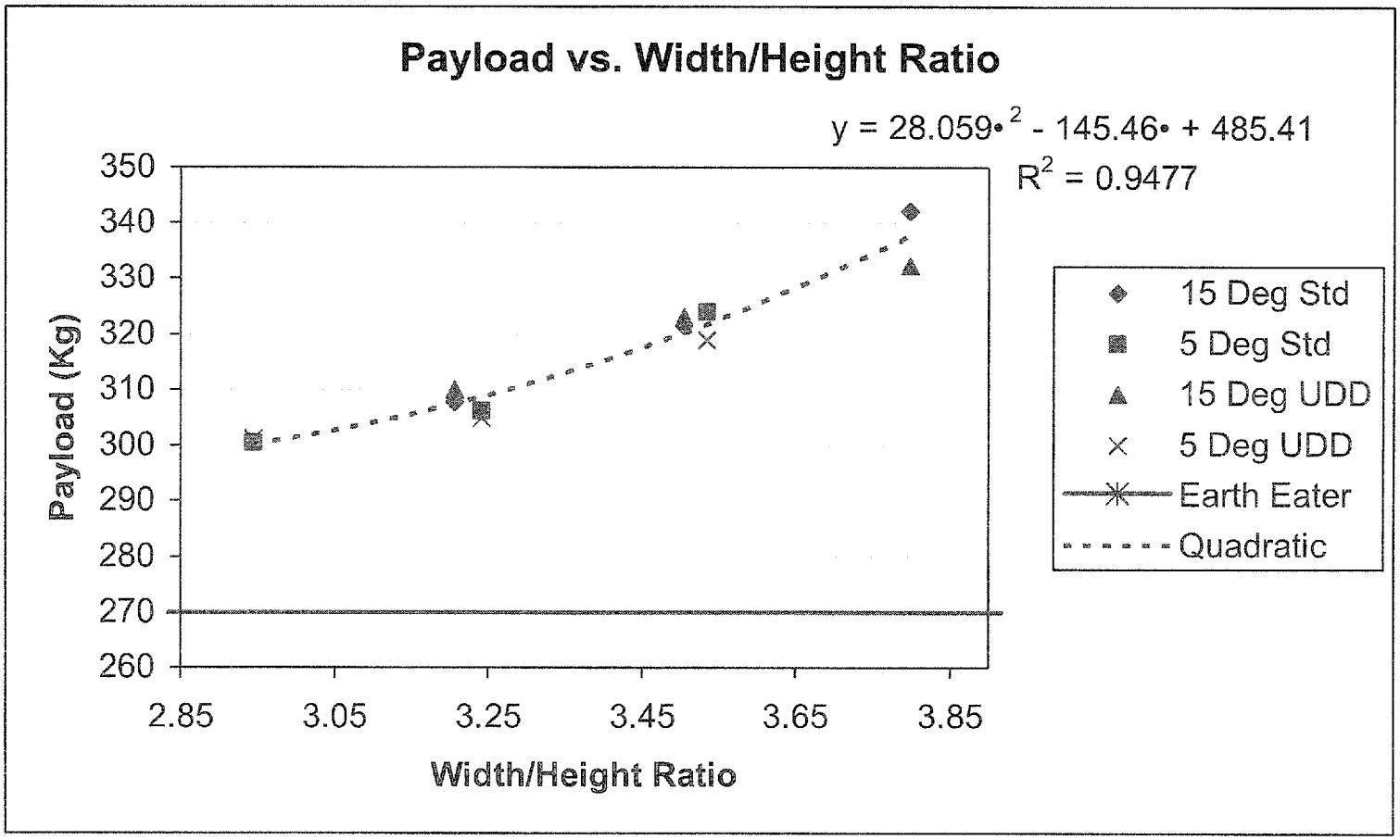
FIG. 6 shows the graphical relationship between payload and the width:height ratio of the bucket mouth.
Figure 7:
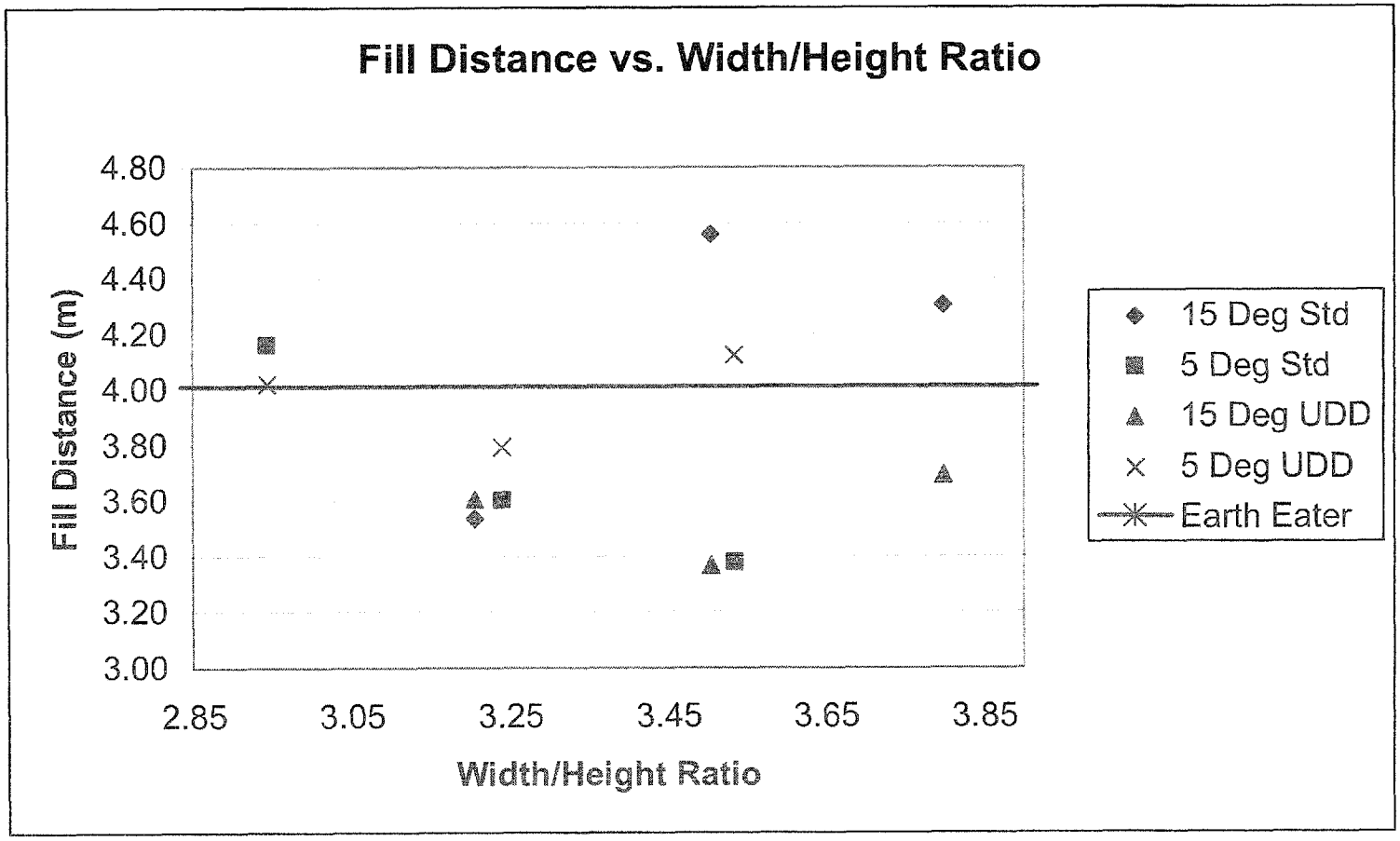
FIG. 7 shows the relationship between fill distance and the width:height ratio of the bucket mouth.
Figure 8:
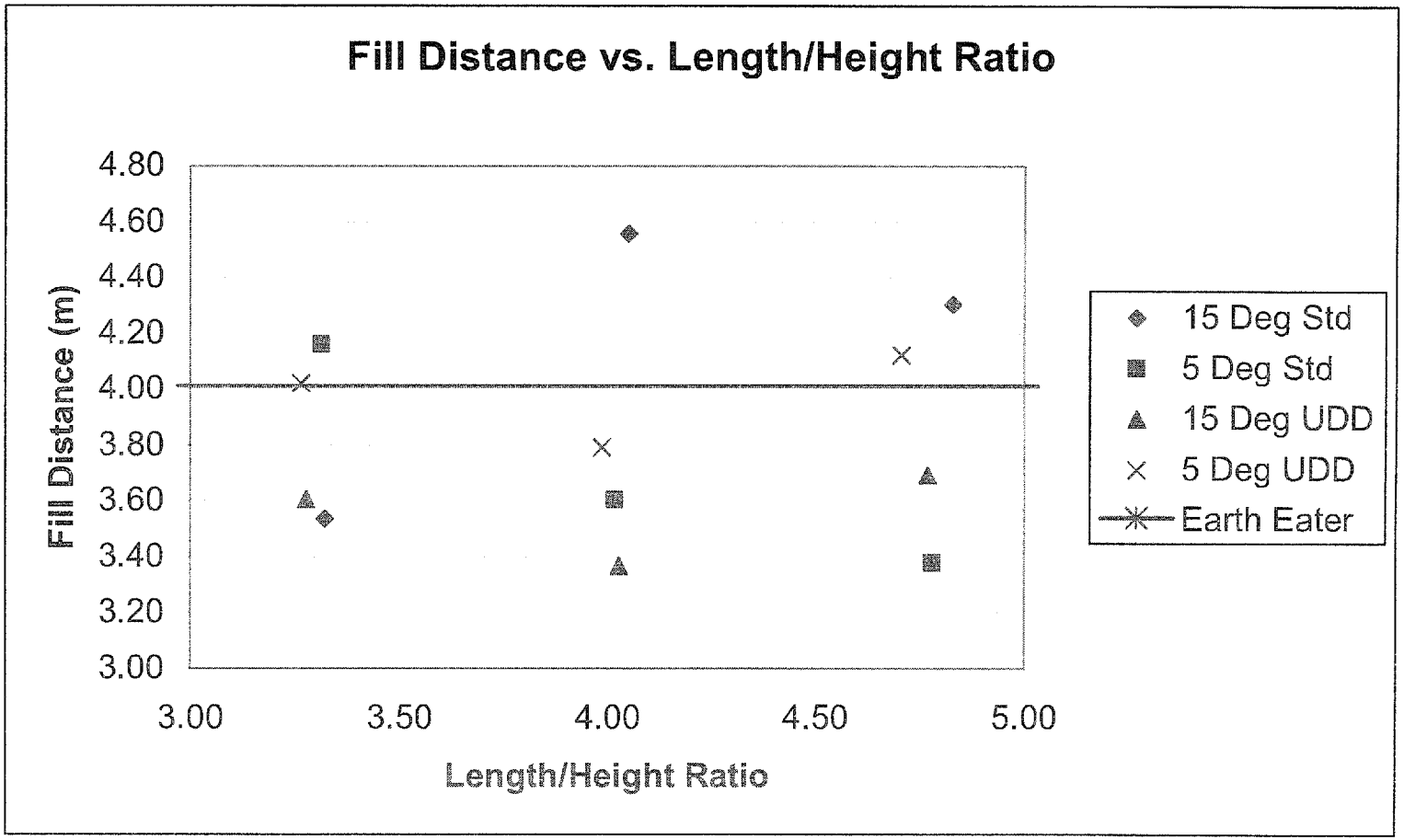
FIG. 8 shows the relationship between fill distance and the length:height ratio of the bucket.
Figure 9:
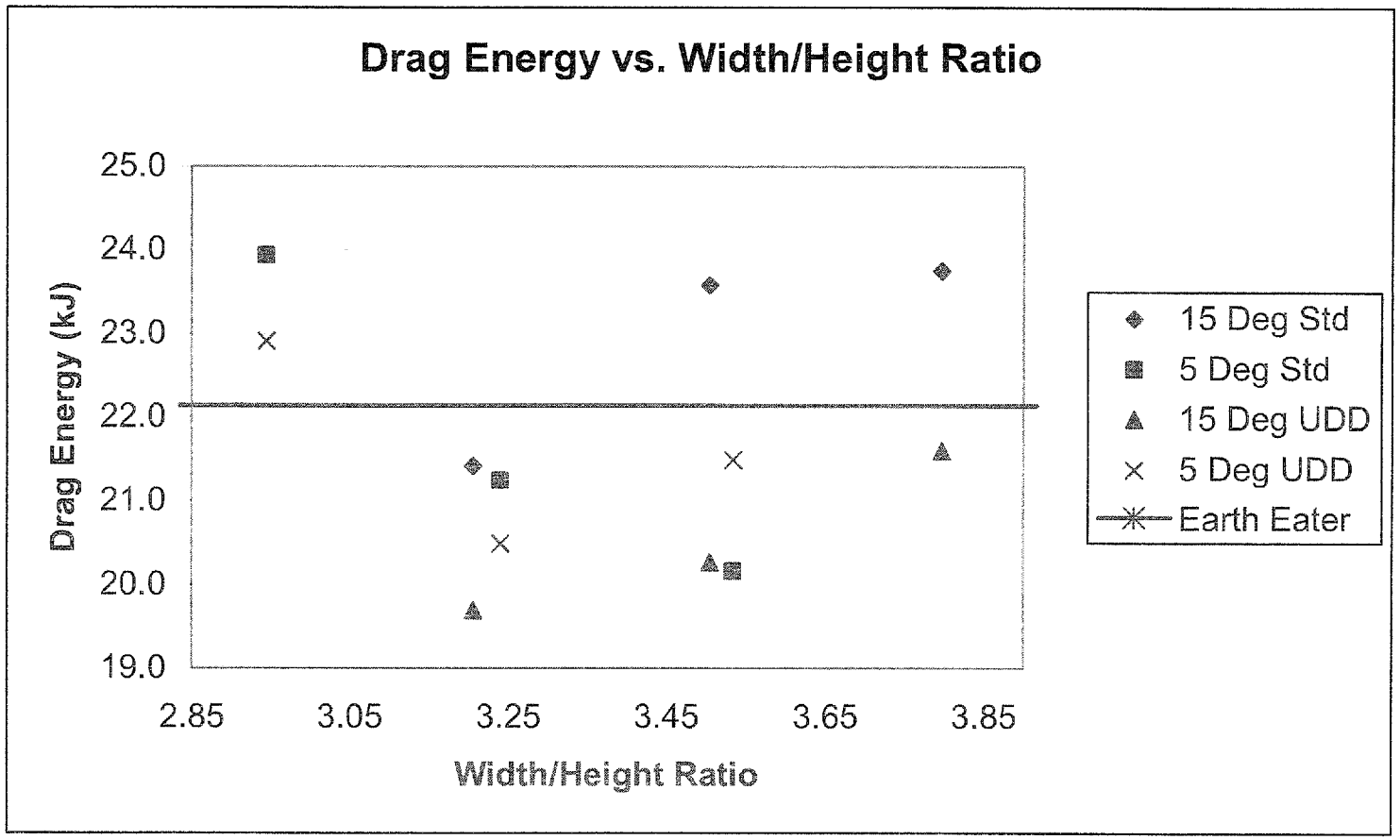
FIG. 9 shows the relationship between drag energy and the width:height ratio of the bucket mouth.
Figure 10:
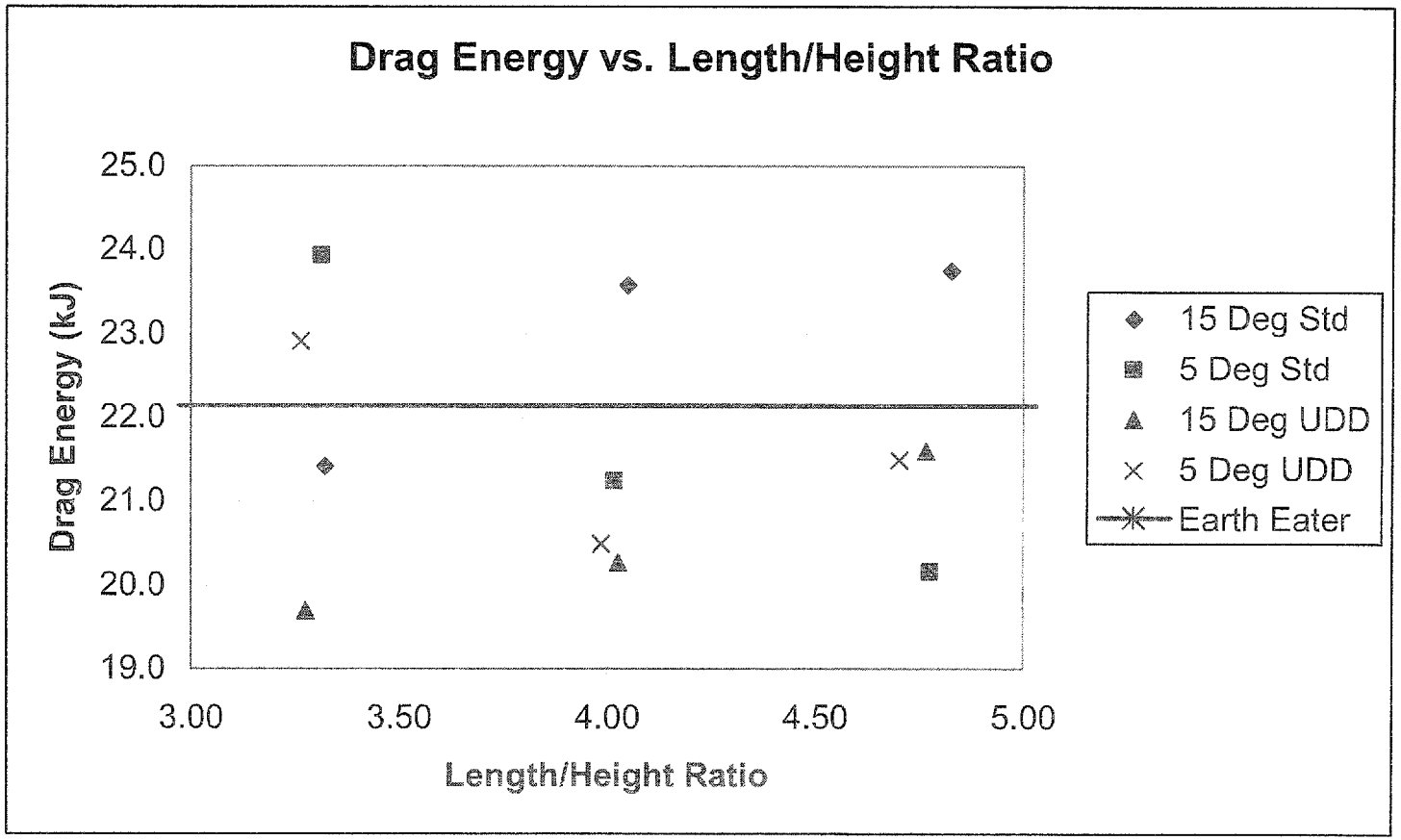
FIG. 10 shows the relationship between drag energy and the length:height ratio of the bucket.
Figure 11:
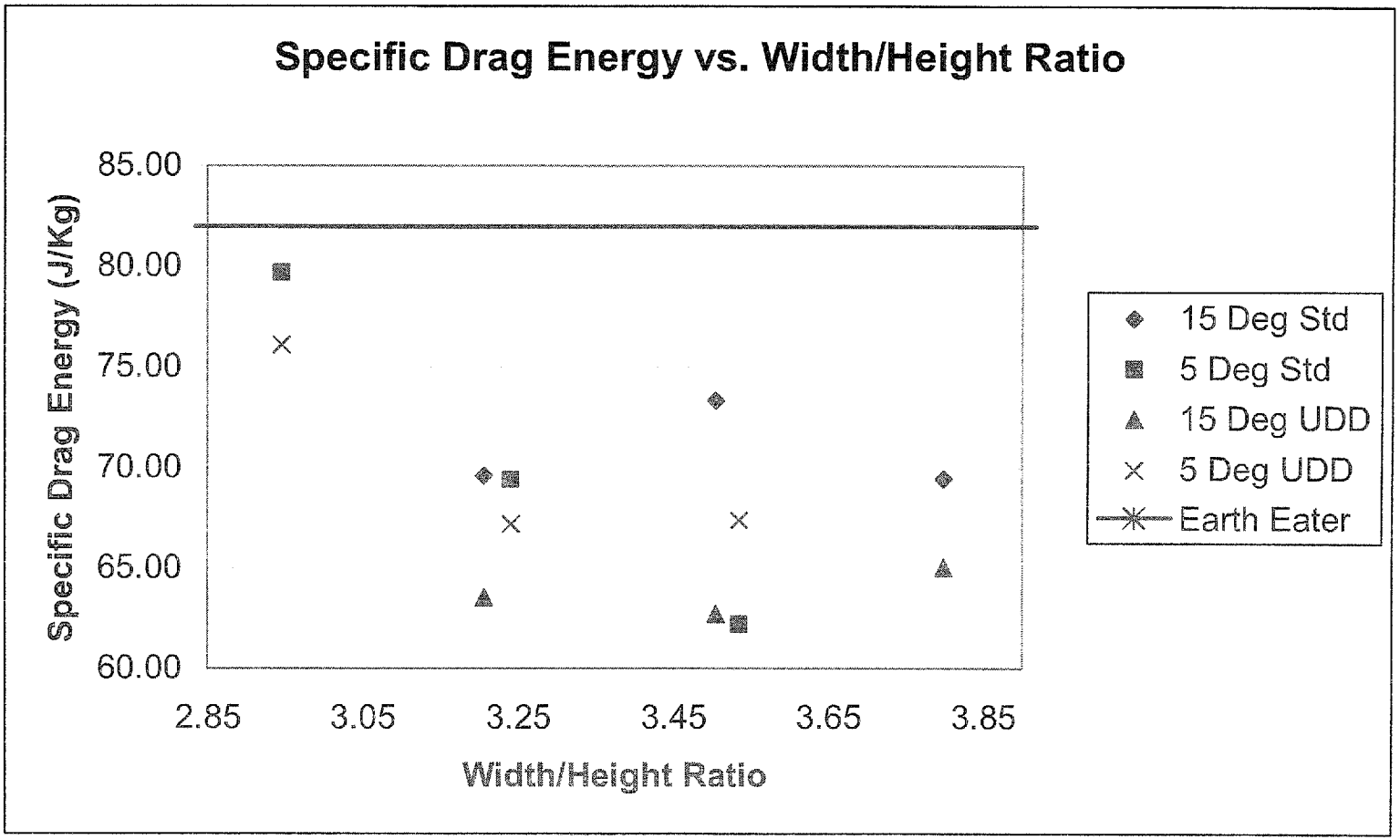
FIG. 11 shows the relationship between specific drag energy and the width:height ratio of the excavator buckets analysed.

FIG. 6: Payload vs Width/Height Ratio
FIG. 7: Fill Distance vs Width/Height Ratio
FIG. 8: Fill Distance vs Length/Height Ratio
FIG. 9: Drag Energy vs Width/Height Ratio
FIG. 10: Drag Energy vs Length/Height Ratio
FIG. 11: Specific Drag Energy vs Width/Height Ratio While certain of the results obtained appeared to be somewhat ambiguous or otherwise somewhat inconclusive, the results did establish a strong relationship between payload and the width to height aspect ratio of the bucket mouth. Notwithstanding the inconclusive or anomalous results, Table 2 illustrated that overall, each of the buckets tested achieved greater payloads than the conventional "EARTHEATER"™ bucket which generally represents the state of the art for contemporary heavy duty excavator buckets.

The most efficient bucket tested appeared to be bucket number 8 which possessed side walls inclined at 15° and a width to height ratio of the bucket mouth of 3.5:1 although other buckets 7 and 9 with 15° walls and bucket mouth width to height ratios between 3.2:1 and 3.8:1 still showed vastly improved performance.

On the basis of the results obtained, the inventors have postulated that vastly improved bucket efficiencies approaching optimal efficiency can be obtained wherein the bucket mouth width to height ratio is in the range of from 3.1 to 3.6:1 and the included angle between each side wall and the floor is in the range of from 95° to 110°. It is also believed that a rear wall with a tapered or radiussed transition into the opposed side walls is a contributing factor to overall bucket efficiency as is the bucket length to width ratio which appears to offer superior results in the range of from 1:1 to 1.25:1.

Although further trails with finer bucket geometry variations and differing soil types may point to more precise optimization of bucket geometry, initial trials on a full scale bucket similar to bucket number 8 show a close correlation in bucket efficiencies, sufficient at least to support the inventors' postulations as to the preferred bucket geometry ranges referred to above.

While the most pronounced bucket efficiencies were exhibited with 15° inclined side walls and bucket mouth width:height ratios in the range of from 3.1 to 3.6:1 empirical observations suggest that, notwithstanding the otherwise inconclusive test results, there is some contribution to

TABLE 2

| Bucket Number | Rear End | Side Angle | Width/ Height | Length/ Width | Length/ Height | Payload (kg) | Fill Distance (m) | Drag Energy (kJ) | Specific Drag Energy (J/kg) |
|---|---|---|---|---|---|---|---|---|---|
| 1 | Standard | 15 | 3.21 | 1.04 | 3.32 | 308 | 3.54 | 21.4 | 69.6 |
| 2 | | | 3.50 | 1.16 | 4.05 | 322 | 4.56 | 23.6 | 73.3 |
| 3 | | | 3.80 | 1.27 | 4.83 | 342 | 4.30 | 23.8 | 69.4 |
| 4 | | 5 | 2.94 | 1.13 | 3.31 | 300 | 4.16 | 23.9 | 79.7 |
| 5 | | | 3.24 | 1.24 | 4.02 | 306 | 3.60 | 21.2 | 69.4 |
| 6 | | | 3.53 | 1.35 | 4.78 | 324 | 3.38 | 20.2 | 62.2 |
| 7 | Tapered | 15 | 3.21 | 1.02 | 3.28 | 310 | 3.61 | 19.7 | 63.5 |
| 8 | Rear | | 3.50 | 1.15 | 4.03 | 323 | 3.37 | 20.3 | 62.7 |
| 9 | Corners | | 3.80 | 1.26 | 4.77 | 332 | 3.69 | 21.6 | 65.0 |
| 10 | | 5 | 2.94 | 1.11 | 3.27 | 301 | 4.02 | 22.9 | 76.1 |
| 11 | | | 3.24 | 1.23 | 3.99 | 305 | 3.79 | 20.5 | 67.2 |
| 12 | | | 3.53 | 1.33 | 4.70 | 319 | 4.12 | 21.5 | 67.4 |
| CQMS EARTHEATER | | | 1.65 | 1.18 | 1.94 | 270 | 4.01 | 22.1 | 82.0 |

bucket efficiency where the bucket has chamfered or tapered corners in the rear walls and/or the bucket length/width ratio is in the range of from 1.1 to 1.25:1. On the basis of the test results obtained, it has not been possible so far to quantify or specify the particular interrelationships between all of the bucket geometry variables, FIG. 6 does show a clear relationship between payload and the width/height ratio of the bucket mouth.

Similarly, initial empirical evaluations of a full scale bucket trial support the notion that the exoskeletal structure of the bucket possesses a superior level of robustness and longevity than a conventional heavy duty bucket construction but also exhibits specific drag properties similar to a light-weight excavator bucket. By utilising cast components welded together to form an integral frame structure and then applying steel plates thereto to form the side walls, floor and rear wall, the structural integrity of such a bucket is considered superior to a heavy duty bucket of similar mass constructed with a cast lip and side wings only with the remainder being fabricated from plate steel components.

In an attempt to more precisely optimize bucket geometry, tests were conducted on two adjustable buckets having side walls inclined at angles of approximately 5 degrees and 10 degrees, respectively, to a vertical plane. These tests were carried out on basis of the parameters above (i.e. W/H, L/W and L/H etc.), which have been identified in an non-obvious manner in the present invention as warranting further attention. The bucket configurations trialed during these tests are outlined in Table 3 below.

TABLE 3

| ANGLE (DEG) | CONFIGURATION | W/H | L/W | L/H | L (mm) | W (mm) | H (mm) | STRUCK CAPACITY (L) |
|---|---|---|---|---|---|---|---|---|
| 15 | 1 | 2.50 | 0.82 | 2.05 | 795 | 652 | 318 | 137.3 |
| | 2 | 2.92 | 0.93 | 2.71 | 782 | 727 | 268 | 137.4 |
| | 3 | 3.21 | 1.04 | 3.34 | 775 | 806 | 241 | 137.4 |
| | 4 | 3.57 | 1.15 | 4.09 | 768 | 880 | 215 | 137.5 |
| | 5 | 3.80 | 1.23 | 4.69 | 764 | 942 | 201 | 137.5 |
| | 6 | 4.09 | 1.34 | 5.48 | 760 | 1019 | 186 | 137.5 |
| | 7 | 4.37 | 1.45 | 6.34 | 756 | 1097 | 173 | 137.5 |
| 5 | 8 | 2.34 | 0.91 | 2.13 | 732 | 666 | 313 | 137.7 |
| | 9 | 2.65 | 1.02 | 2.71 | 729 | 744 | 275 | 136.7 |
| | 10 | 2.94 | 1.13 | 3.33 | 727 | 822 | 247 | 137.5 |
| | 11 | 3.25 | 1.24 | 4.03 | 725 | 898 | 223 | 137.3 |
| | 12 | 3.53 | 1.35 | 4.76 | 723 | 976 | 205 | 137.6 |

TABLE 3-continued

| ANGLE (DEG) | CONFIGURATION | W/H | L/W | L/H | L (mm) | W (mm) | H (mm) | STRUCK CAPACITY (L) |
|---|---|---|---|---|---|---|---|---|
| | 13 | 3.82 | 1.46 | 5.58 | 722 | 1054 | 189 | 137.3 |
| | 14 | 4.11 | 1.58 | 6.49 | 720 | 1135 | 175 | 137.1 |

To simplify construction of the above adjustable buckets in Table 3, a conventional rectangular rear wall curving upwardly from the floor was implemented without the use of tapered rear corners. To provide a form of consistency between the results, the ratio between i) the distance from a reference point to the trunnion bracket; and ii) the distance from the reference point to the estimated center of mass for the payload was kept substantially constant.

Similar to the tests relating to Table 2 above, to test the above bucket configurations in Table 3, a pit was setup. A dragline was used to move the bucket in their associated configurations in Table 3 through the pit such that each bucket configuration was not digging rehandled material. It is noted that the pit used in relation to Table 3 contained different material from that used to produce the results in Table 2. In addition, the results with regards to configurations 3 and 10 were affected by rain.

Table 4 below shows the normalized results of the above tests for the bucket configurations shown in Table 3.

TABLE 4

| ANGLE (DEG) | CONFIG | W/H | L/W | L/H | Payload (kg) | Fill Distance (m) | Fill Time (s) | Drag energy (kJ) | Specific Drag Energy (J/kg) | Material |
|---|---|---|---|---|---|---|---|---|---|---|
| 15 | 1 | 2.50 | 0.82 | 2.05 | 240 | 3.14 | 5.8 | 9.9 | 41 | NEW - REHANDLE 4 |
| | 2 | 2.92 | 0.93 | 2.71 | 251 | 3.09 | 6.5 | 9.8 | 39 | NEW - REHANDLE 3 |
| | 3 | 3.21 | 1.04 | 3.34 | 262 | 3.69 | 6.9 | 11.4 | 44 | OLD - REHANDLE 1 |
| | 4 | 3.57 | 1.15 | 4.09 | 279 | 3.45 | 7.4 | 10.7 | 36 | NEW - REHANDLE 1 |
| | 5 | 3.80 | 1.23 | 4.69 | 270 | 3.22 | 6.9 | 11.7 | 43 | NEW - REHANDLE 2 |
| | 6 | 4.09 | 1.34 | 5.48 | 282 | 2.96 | 6.4 | 10.8 | 38 | NEW - REHANDLE 2 |
| | 7 | 4.37 | 1.45 | 6.34 | 283 | 3.33 | 7.7 | 10.8 | 38 | NEW - REHANDLE 3 |
| 5 | 8 | 2.34 | 0.91 | 2.13 | 227 | 3.06 | 5.6 | 10.2 | 45 | NEW - REHANDLE 4 |
| | 9 | 2.65 | 1.02 | 2.71 | 252 | 3.18 | 6.3 | 10.3 | 41 | NEW - REHANDLE 3 |
| | 10 | 2.94 | 1.13 | 3.33 | 242 | 3.70 | 7.9 | 11.2 | 46 | OLD - REHANDLE 1 |
| | 11 | 3.25 | 1.24 | 4.03 | 271 | 3.38 | 7.3 | 11.1 | 41 | NEW - REHANDLE 1 |
| | 12 | 3.53 | 1.35 | 4.76 | 288 | 3.42 | 5.0 | 12.2 | 42 | NEW - REHANDLE 1 |
| | 13 | 3.82 | 1.46 | 5.58 | 276 | 3.51 | 7.4 | 12.5 | 45 | NEW - REHANDLE 2 |
| | 14 | 4.11 | 1.58 | 6.49 | 271 | 3.14 | 7.2 | 9.3 | 34 | NEW - REHANDLE 3 |

Figure 12:
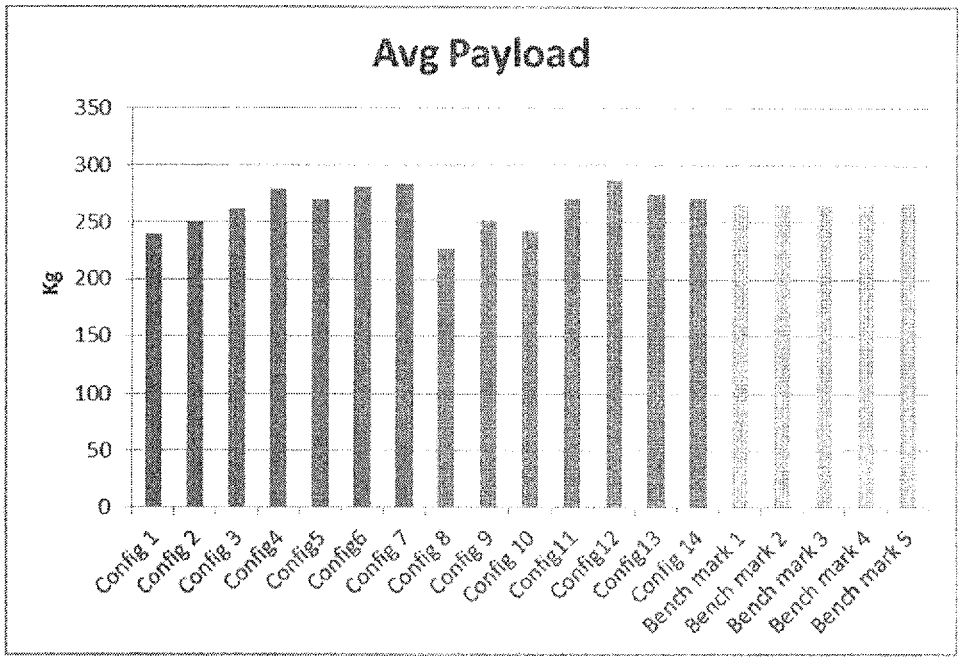
FIG. 12 shows the average payload of further excavator buckets analysed relative to industry benchmarks.
Figure 13:
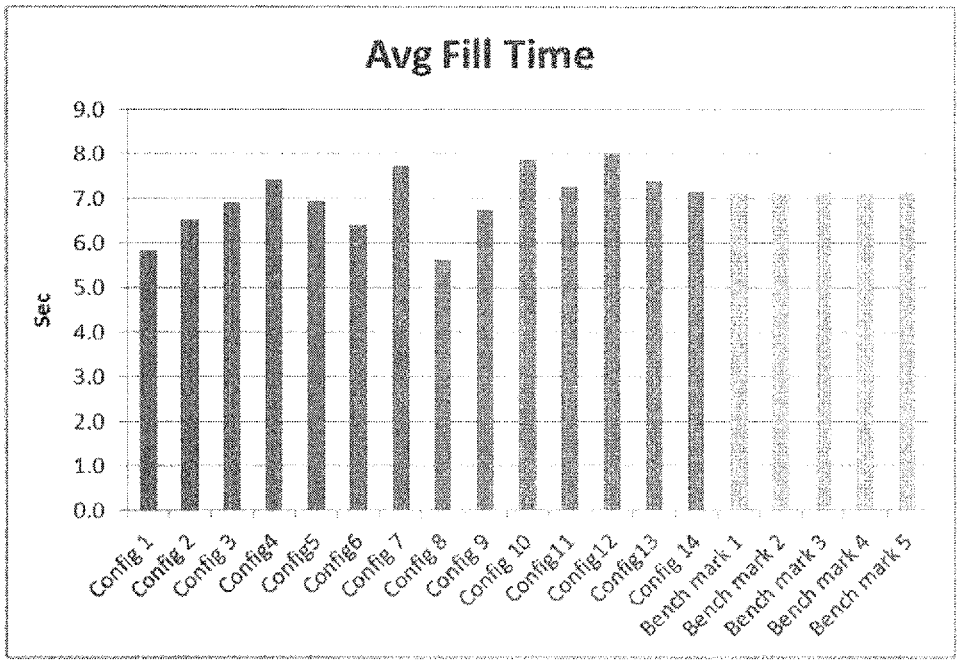
FIG. 13 shows the average fill time of further excavator buckets analysed relative to industry benchmarks.
Figure 14:
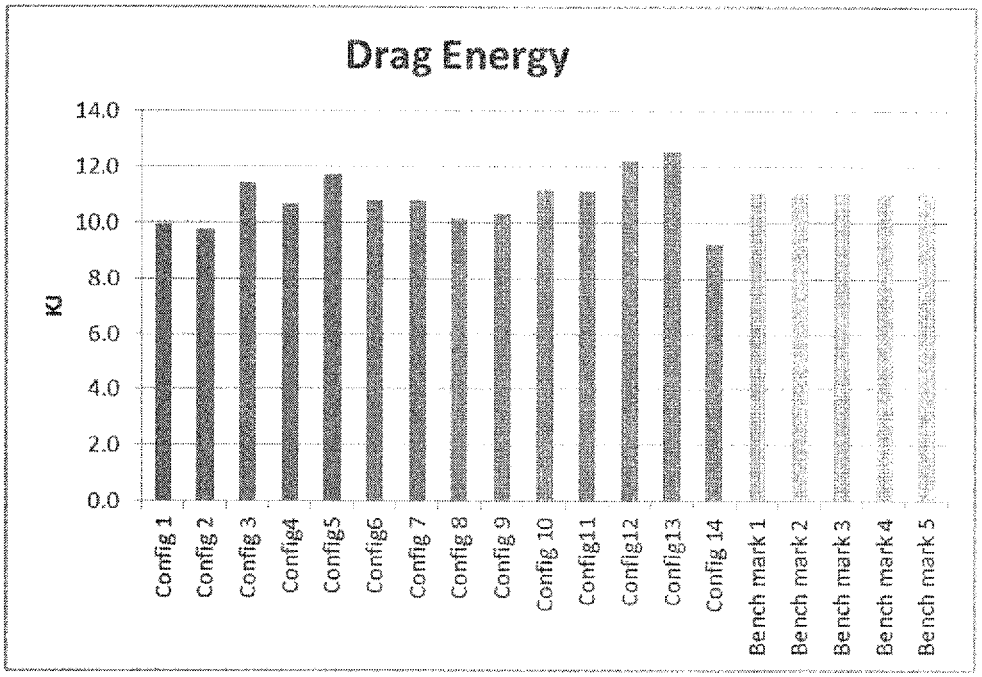
FIG. 14 shows the drag energy of further excavator buckets analysed relative to industry benchmarks.
Figure 15:
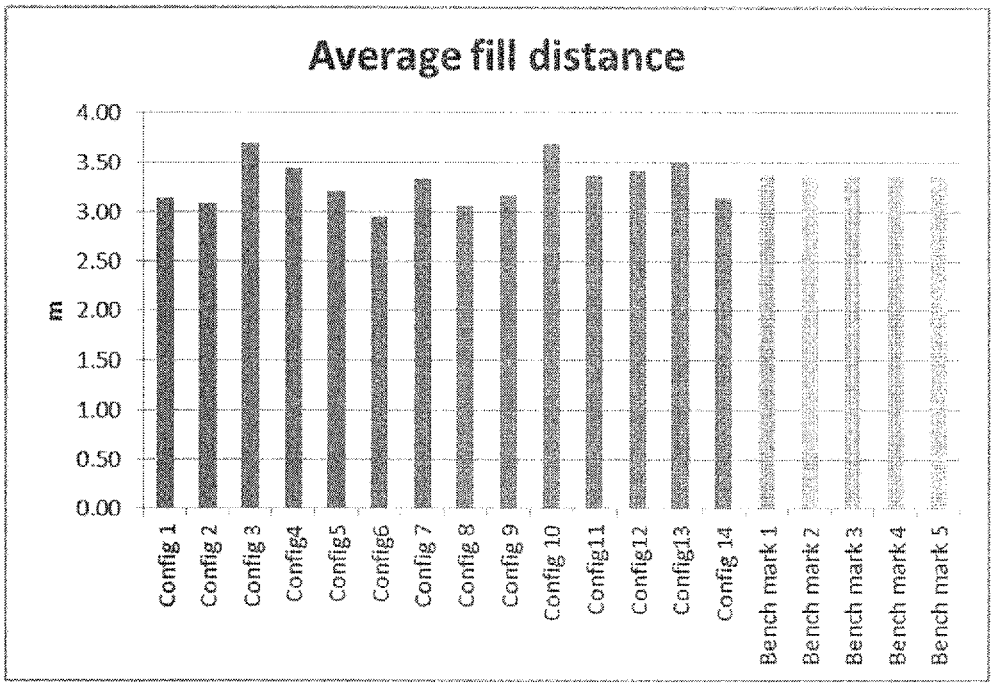
FIG. 15 shows the average fill distance of further excavator buckets analysed relative to industry benchmarks.

Results from Table 4 have been plotted in FIGS. 12 to 14 relative to buckets configurations in Table 2. Buckets from Table 2 have been used as a bench mark for comparison. From the results in Table 4 and FIGS. 12 to 14, the most efficient bucket tested appeared to be configuration 14 although bucket configurations 2, 4 and 6 to 7 also showed further improved performance.

On the basis of the results obtained, the inventors have further postulated that improved bucket efficiencies can be obtained through i) the bucket mouth to lip ratio being approximately 2.50 to 4.4:1.0; and/or ii) the length to width ratio being approximately 0.8 to 1.6:1.0.

In particular, with a side wall angle of approximately 5 or 15 degrees, improvement is shown in bucket mouth to lip ratio being over 4.0:1.0. Furthermore, a length to height ratio above 2.0:1.0 (i.e. greater than the CQMS EARTHEATER) shows further improvement.

It has also been observed by the inventors that the shorter bucket configurations (e.g. configurations 1-2 and 8-9) fill in a shorter distance at all depth. The longer buckets (e.g. configurations 6-7 and 13-14) did not appear to fill all the way to the end of the bucket whilst being dragged through the pit but, when the bucket disengaged from the pit, material would flow and fill the rearward portion of the bucket. This may assist in lowering their specific drag energies. The mid bucket configurations (e.g. configurations 3-5 and 10-12) filled all the way to the back of the buckets whilst the bucket was being dragged through the pit.

It readily will be apparent to persons skilled in the art that many modifications and variations may be made to the invention without departing from the spirit and scope thereof. For example, as the exoskeletal structure is fabricated from a plurality of cast steel components welded together, excavator buckets according to the invention may be constructed as modular constructions with, say, a fixed lip width but with variable bucket length and side wall height for use in specific applications.

The invention claimed is:

1. An excavator bucket comprising:— a generally rectangular floor, opposed side walls and a rear wall;

a lip member extending transversely of a front portion of said floor, said lip member including spaced mountings for replaceable wear members;

opposed wing members adjacent respective front portions of said side walls, said wing members including mountings for replaceable wear members, said wing members each including a drag rope mounting located forwardly of a front edge of said lip member; said excavator bucket characterized in that said side walls incline outwardly towards respective upper regions thereof at an angle of from 5° to 20° relative to a plane perpendicular to a plane of said floor, said excavator bucket further characterized in that a ratio of lip width to side wall height in the region of said lip member is in the range of from 2.5:1.0 to 4.4:1.0 and the ratio of the length of the floor to the width of the floor is in the range of from 0.8:1.0 to 1.6:1.0.

2. An excavator bucket as claimed in claim 1 wherein side walls incline outwardly at an angle of from 10° to 15°.

3. An excavator bucket as claimed in claim 2 wherein said side walls incline outwardly at an angle from 12° to 15°.

4. An excavator bucket as claimed in claim 1 wherein said ratio of lip width to side wall height is in the range of from 3.2 to 3.5:1.

5. An excavator bucket as claimed in claim 4 wherein said ratio of lip width to side wall height is in the range of from 3.3 to 3.4:1.

6. An excavator bucket as claimed in claim 1 wherein said bucket includes an arch member extending between said opposed wing members.

7. An excavator bucket as claimed in claim 6 wherein said arch member comprises a hollow cast steel member.

8. An excavator bucket as claimed in claim 1 wherein said bucket comprises cast steel junction members between said floor and said side walls and said side walls and said rear wall respectively, said junction members being shaped to provide a smooth arcuate transition between adjacent said floor and said side walls and said side walls and said rear wall respectively.

9. An excavator bucket as claimed in claim 1 wherein said rear wall curves upwardly from a junction with said floor.

10. An excavator bucket as claimed in claim 1 wherein a cast steel cap rail extends along the upper edges of said side walls and said rear wall.

11. An excavator bucket as claimed in claim 1 wherein a cast steel reinforcing member extends transversely over an outer surface of a lower portion of said rear wall.

12. An excavator bucket as claimed in claim 1 wherein said bucket comprises an exoskeletal structure of cast steel components supporting plate steel floor, side wall and rear wall members.

13. An excavator as claimed in claim 12 wherein said exoskeletal structure comprises said lip member, said wing members, junction members and a cap rail.

14. An excavator bucket as claimed in claim 13 wherein said exoskeletal structure includes an arch member.

15. An excavator bucket as claimed in claim 13 wherein said exoskeletal structure includes a cast steel reinforcing member extending between opposed junction members.

16. An excavator bucket as claimed in claim 13 wherein said exoskeletal structure includes coupling members extending between said junction members and said cap rail adjacent said rear wall.

17. An excavator bucket as claimed in claim 16 wherein said coupling members comprise trunnion mounts.

18. An excavator bucket as claimed in claim 1 wherein said bucket includes payload spill containment members extending adjacent rear upper edges of said side walls and said rear wall.

19. An excavator bucket comprising:— a generally rectangular floor, opposed side walls and a rear wall;

a lip member extending transversely of a front portion of said floor, said lip member including spaced mountings for replaceable wear members;

opposed wing members adjacent respective front portions of said side walls, said wing members including mountings for replaceable wear members, said wing members each including a drag rope mounting located forwardly of a front edge of said lip member; said excavator bucket characterized in that said side walls incline outwardly towards respective upper regions thereof at an angle of from 5° to 20° relative to a plane perpendicular to a plane of said floor, said excavator bucket further characterized in that a ratio of lip width to side wall height in the region of said lip member is in the range of from 2.5:1 to 4.4:1 and the ratio of the length of the floor to the width of the floor is in the range of from 0.8:1.0 to 1.6:1.0, said excavator bucket further characterized in that an upper portion of said rear wall inclines outwardly from a lower portion of said rear wall.

20. An excavator bucket comprising:

a generally rectangular floor, opposed side walls and a rear wall;

a lip member extending transversely of a front portion of said floor, said lip member including spaced mountings for replaceable wear members;

opposed wing members adjacent respective front portions of said side walls, said wing members including mountings for replaceable wear members, said wing members each including a drag rope mounting located forwardly of a front edge of said lip member; said excavator bucket characterized in that a ratio of lip width to side wall height in the region of said lip member is in the range of from 2.5:1.0 to 4.4:1.0 and the ratio of the length of the floor to the width of the floor is in the range of from 0.8:1.0 to 1.6:1.0.

* * * * *